United States Patent [19]

Seemuth

[11] Patent Number: 4,522,630

[45] Date of Patent: Jun. 11, 1985

[54] DIESEL FUEL COMPOSITION

[75] Inventor: Paul D. Seemuth, Baton Rouge, La.

[73] Assignee: Ethyl Corporation, Richmond, Va.

[21] Appl. No.: 594,924

[22] Filed: Mar. 29, 1984

[51] Int. Cl.[3] ..... C10L 1/22

[52] U.S. Cl. ..... 44/53; 44/56; 44/57; 44/63; 549/476

[58] Field of Search ..... 44/57, 53, 56, 63; 549/476

[56] References Cited

U.S. PATENT DOCUMENTS

| | | | |
|---|---|---|---|
| 3,213,112 | 10/1965 | Neeley | 549/475 |
| 4,405,335 | 9/1983 | Selmuth | 44/57 |
| 4,406,665 | 9/1983 | Filbey | 44/63 |

FOREIGN PATENT DOCUMENTS 6636 4/1983 Brazil .

*Primary Examiner*—William R. Dixon, Jr.
*Assistant Examiner*—Margaret B. Medley
*Attorney, Agent, or Firm*—Donald L. Johnson; John E. Sieberth; W. G. Montgomery

[57] ABSTRACT

Cetane number of diesel fuel is increased by the addition of a tetrahydro-2,5-furandimethanol dinitrate.

5 Claims, No Drawings

DIESEL FUEL COMPOSITION

BACKGROUND OF THE INVENTION

Diesel engines operate by compression ignition. They have compression ratios in the range of 14:1 to 17:1 or higher and for that reason obtain more useful work from a given amount of fuel compared to an Otto cycle engine. Historically, diesel engines have been operated on a petroleum-derived liquid hydrocarbon fuel boiling in the range of about 300°–750° F. Recently, because of dwindling petroleum reserves, alcohol and alcoholhydrocarbon blends have been studies for use as diesel fuel.

One major factor in diesel fuel quality is cetane number. Cetane number is related to ignition delay after the fuel is injected into the combustion chamber. If ignition delays too long, the amount of fuel in the chamber increases and upon ignition results in a rough running engine and increased smoke. A short ignition delay results in smooth engine operation and decreases smoke. Commercial petroleum diesel fuels generally have a cetane number of about 40–55. Alcohols have a much lower cetane value and require the addition of a cetane improver for successful engine operation.

Through the years, many types of additives have been used to raise the cetane number of diesel fuel. These include peroxides, nitrites, nitrates, nitrosocarbamates, and the like. Alkyl nitrates such as amyl nitrate, hexylnitrate and mixed octyl nitrates have been used commercially with good results.

SUMMARY

It has now been discovered that the cetane rating of diesel fuel, both hydrocarbon and alcohols or mixtures thereof, can be increased by the addition of a tetrahydro-2,5-furandimethanol dinitrate.

DESCRIPTION OF PREFERRED EMBODIMENTS

A preferred embodiment of the invention is a liquid fuel adapted for use in a diesel engine, said fuel being selected from the group consisting of liquid hydrocarbons of the diesel boiling range, alcohols and mixtures thereof, said fuel containing a cetane number increasing amount of a fuel soluble tetrahydro-2,5-furandimethanol dinitrate. Such compounds contain in their structure the group

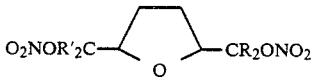

wherein the ring may be substituted with any of a broad range of substituents as long as they do not render the compound insoluble in diesel fuel.

A still more preferred group of additives have the structure

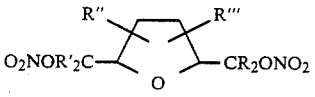

wherein R, R', R'' and R''' are hydrogen and R'' and R''' are independently selected from the group consisting of hydrogen, alkyls 2–20 carbon atoms, aryl containing 6–12 carbon atoms and aralkyl containing 7–12 carbon atoms.

Representative examples of these additives include:

2-(4-phenyl-5-nitratomethyltetrahydro-2-furyl)butan-2-ol nitrate 2-(3-ethyl-5-nitratomethyltetrahydro-2-furyl)dodecan-2-ol nitrate 2-(3,4-dimethyl-5-nitratomethyltetrahydro-2-furyl)hexan-2-ol nitrate 2-[4,4-diethyl-5-(2-nitrato-2-propyl)tetrahydro-2-furyl]-nona-2-ol nitrate 2-[3-naphthyl-5-(2-nitrato-2-butyl)tetrahydro-2-furyl]-3-phenylbutan-2-ol nitrate.

In a more preferred embodiment, R and R' are hydrogen and R'' and R''' are selected from the group consisting of hydrogen, alkyls containing 1–20 carbon atoms, cycloalkyl containing 5–8 carbon atoms, alkenyl containing 2–20 carbon atoms, aryl containing 6–12 carbon atoms or aralkyl containing 7–12 carbon atoms in the above structure. These compounds include:

3,4-dimethyltetrahydro-2,5-furandimethanol dinitrate 5-ethyltetrahydro-2,5-furandimethanol dinitrate 4,5-dibutyltetrahydro-2,5-furandimethanol dinitrate 3,5-dihexyltetrahydro-2,5-furandimethanol dinitrate 4-dodecyltetrahydro-2,5-furandimethanol dinitrate 4-(2-pyridyl)tetrahydro-2,5-furandimethanol dinitrate.

In the most preferred additive R, R', R'' and R''' are hydrogen which has the structure

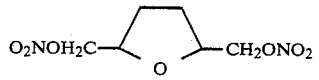

The additives can readily be prepared by nitration of the corresponding tetrahydro-2,5-furan dimethanol by standard procedures such as by the use of mixed nitric-sulfuric acid or acetic anhydride-nitric acid. The tetrahydrofuran dialkanol species is added to a rapidly stirred mixed acid at low temperature such as −20° to 10° C., more preferably about −15° to −5° C.

EXAMPLE 1

In a reaction vessel was placed 31.2 mLs of 70% nitric acid and 42 mLs of 20% oleum. The acid mixture was cooled to −12° C. and 26.4 g of tetrahydro-2,5-furandimethanol was added at such a rate so as to maintain temperature at −12° to −9° C. After addition was complete, the reaction mixture was diluted with 150 mLs of ice water. The product was extracted from the aqueous layer using 2×50 mLs volumes of methylene chloride. The combined organic extractions were neutralized with sodium bicarbonate and dried over sodium sulfate. Filtration and removal of solvent under vacuo afforded a yellow oil was identified as tetrahydro-2,5-furandimethanol dinitrate by IR and NMR (97% yield of theory).

Other tetrahydro-2,5-furandimethanol dinitrate esters can be made by following the above general procedure.

The amount of cetane improver added depends on the type of fuel being used, the initial cetane value, and the amount of cetane number increase desired. Alcohol fuels such as methanol, ethanol, isopropanol, isobutanol, hexanol, and the like, have very low cetane values and large amounts of cetane improvers are required. A useful range in which to operate is about 5–25 weight percent cetane improver.

Blends of alcohol and petroleum-derived diesel fuel have higher cetane values and require less cetane improver. A useful range is about 0.5–10 weight percent.

Petroleum-derived distillate fuels in the diesel boiling range require only small amounts of cetane improver to achieve a significant increase in cetane number. Such fuels without any cetane improver generally have cetane numbers in the range of about 25–60. Cetane numbers in the range of 25–35 are considered low and those in the range of 50–60 are considered top grade diesel fuels. Diesel fuels in the 35–50 mid-range are most common. An object of the invention is to upgrade the low cetane number fuels at least into the mid-range and to increase the cetane value of the mid-range fuels into the upper portion of the mid-range (e.g., 45–50) or even into the premium range above 50. It has been found that highly beneficial results can be achieved using as little as 0.05 weight percent of the present additive. Accordingly, a useful concentration range in petroleum derived diesel fuel is about 0.01–5 weight percent and more preferably about 0.05–0.5 weight percent.

The cetane increase caused by the present additives was measured in comparison to that caused by a commercial cetane improver, isooctyl nitrate. The fuel was a diesel fuel having a cetane number of 45.

| Concentration | Isooctyl Nitrate | tetrahydro-2,5-furandimethanol dinitrate |
|---|---|---|
| None | 45.3 | 45.5 |
| 0.05 | 48.3 | 47.01 |
| 0.1 | 50.8 | 48.04 |
| 0.15 | 52.32 | 49.74 |

These results show that the new additives are very effective in raising the cetane number of diesel fuel.

Other conventional additives may be included in the diesel fuel including anitoxidants, cold flow improvers, cold filter plugging inhibitors, detergents, rust inhibitors, and the like, including other cetane improvers.

I claim:

1. Liquid fuel adapted for use in a diesel engine, said fuel being selected from the group consisting of liquid hydrocarbons of the diesel boiling range, alcohols and mixtures thereof, and said fuel containing a cetane number increasing amount of a fuel soluble tetrahydro-2,5-furandimethanol dinitrate.

2. A composition of claim 1 wherein said fuel is a liquid hydrocarbon of the fuel boiling range.

3. A composition of claim 2 wherein said tetrahydro-2,5-furandimethanol dinitrate has the structure

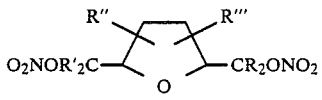

wherein R, R′, R″ and R‴ are independently selected from the group consisting of hydrogen, alkyls containing 1–20 carbon atoms, cycloalkyl containing 5–8 carbon atoms, alkenyl containing 2–20 carbon atoms, aryl containing 6–12 carbon atoms and aralkyl containing 7–12 carbon atoms.

4. A composition of claim 3 wherein R and R′ are hydrogen and R″ and R‴ are independently selected from the group consisting of alkyls containing 1–20 carbon atoms, cycloalkyl containing 5–8 carbon atoms, alkenyl containing 2–20 carbon atoms, aryl containing 6–12 carbon atoms and aralkyl containing 7–12 carbon atoms.

5. A composition of claim 3 wherein R, R′, R″ and R‴ are hydrogen.

* * * * *